United States Patent [19]

Pierrel

[11] 4,177,088

[45] Dec. 4, 1979

[54] PROCESS AND INSTALLATION FOR HEAT TREATING SPHEROIDAL OR LAMELLAR GRAPHITE CAST IRON PIPES

[75] Inventor: Michel Pierrel, Pont-a-Mousson, France

[73] Assignee: Pont-a-Mousson S.A., Nancy, France

[21] Appl. No.: 882,470

[22] Filed: Mar. 1, 1978

[30] Foreign Application Priority Data

Mar. 2, 1977 [FR] France ..... 77 06076

[51] Int. Cl.[2] ..... C21D 1/48

[52] U.S. Cl. ..... 148/15; 148/155; 266/120; 266/131; 266/132; 266/133

[58] Field of Search ..... 266/120, 131, 132, 133; 148/3, 153, 15, 155

[56] References Cited

U.S. PATENT DOCUMENTS

| | | | |
|---|---|---|---|
| 2,029,286 | 2/1936 | Bent et al. | 266/120 |
| 2,087,978 | 7/1937 | Keller | 266/132 |
| 2,445,150 | 7/1948 | Mueller | 148/155 |
| 2,818,075 | 12/1957 | Dunlevy et al. | 266/120 |
| 2,832,700 | 4/1958 | Balestra | 266/120 |
| 3,695,598 | 10/1972 | Ujue | 266/133 |
| 3,888,471 | 6/1975 | Coch | 266/131 |

*Primary Examiner*—John McQuade

*Attorney, Agent, or Firm*—Sughrue, Rothwell, Mion, Zinn and Macpeak

[57] ABSTRACT

A process for effecting an annealing treatment of a spheroidal or lamellar graphite cast iron pipe. While the pipe is driven in rotation about the axis of the pipe, it is suspended substantially horizontally as it issues from the centrifugal casting machine and the pipe is partly immersed in a bath of metal at the desired temperature. An installation for carrying out this process comprises an elongate vessel having a horizontal axis and containing a bath of molten metal at the required temperature. A withdrawable device is provided outside the bath for suspending the pipe in a substantially horizontal position and plunging the pipe partly in the bath while driving the pipe in rotation about the axis of the pipe.

16 Claims, 15 Drawing Figures

PROCESS AND INSTALLATION FOR HEAT TREATING SPHEROIDAL OR LAMELLAR GRAPHITE CAST IRON PIPES

The present invention relates to the heat treatment or annealing of spheroidal or lamellar graphite centrifugally cast iron pipes.

It is known that the reheating or annealing has for purpose to produce two successive transformations of the structure of the pipe: a graphitization between 800° and 1000° C. and a ferritization between 650° and 800° C., these temperature ranges taking into account different types of cast irons. It is also known that if the pipes are cast in shells or moulds provided with a heat insulating refractory coating such as the "wet-spray", the ferritization heat treatment is sufficient.

The usual method of effecting the annealing treatment comprises passing the pipes produced in series through an annealing furnace which is heated by burners and through which flow gaseous currents which are brought to suitable temperatures, the passage of the pipes through the furnace being either continuous or in successive batches.

The treatment in such a furnace gives satisfactory results but has important drawbacks:

its duration is relatively long since the pipes must be maintained at a temperature of about 750° C. for 20 to 25 minutes to which period must be added the times required for the rise in temperature at the inlet of the furnace and the cooling at the outlet of the furnace;

there is a high expenditure of heat since relatively large heat losses occur at the entrance and exit of the furnace: indeed, if the annealing furnace is travelled through continuously by pipes produced in series, the furnace must not be provided with heat-insulated closing doors but with simple flexible curtains through which the pipes pass on conveyor chains; however, if it is preferred to immobilize a batch of pipes inside the furnace so as to close the furnace with heat-insulated doors, the heat losses are much less but they are still inevitable and considerable when these doors are opened.

It will be understood that these drawbacks are accentuated in the case of pipes of large diameter equal to or exceeding 600 mm and even 1 m.

An object of the present invention is to provide a process for effecting an annealing treatment of a spheroidal or lamellar graphite cast iron pipe which permits considerably shortening the annealing period and decreasing to a maximum the heat losses during the treatment.

According to the invention there is provided a process for effecting an annealing treatment of a spheroidal or lamellar graphite cast iron pipe wherein, while the pipe is driven in rotation about the axis of the pipe, it is suspended substantially horizontally as it issues from the centrifugal casting machine and the pipe is partly immersed in a bath of metal at the desired temperature.

Another object of the invention is to provide an installation for carrying out said process. This installation comprises a vessel having an elongated shape and a horizontal axis and adapted to contain a bath of metal, and withdrawable means outside the bath for suspending a pipe in a substantially horizontal position and plunging the pipe partly in the bath while driving the pipe in rotation about the axis of the pipe.

Further features and advantages of the invention will be apparent from the ensuing description with reference to the accompanying drawings which are given solely by way of example and in which.

Figures 1, 2, 3, 4, 5, 6:
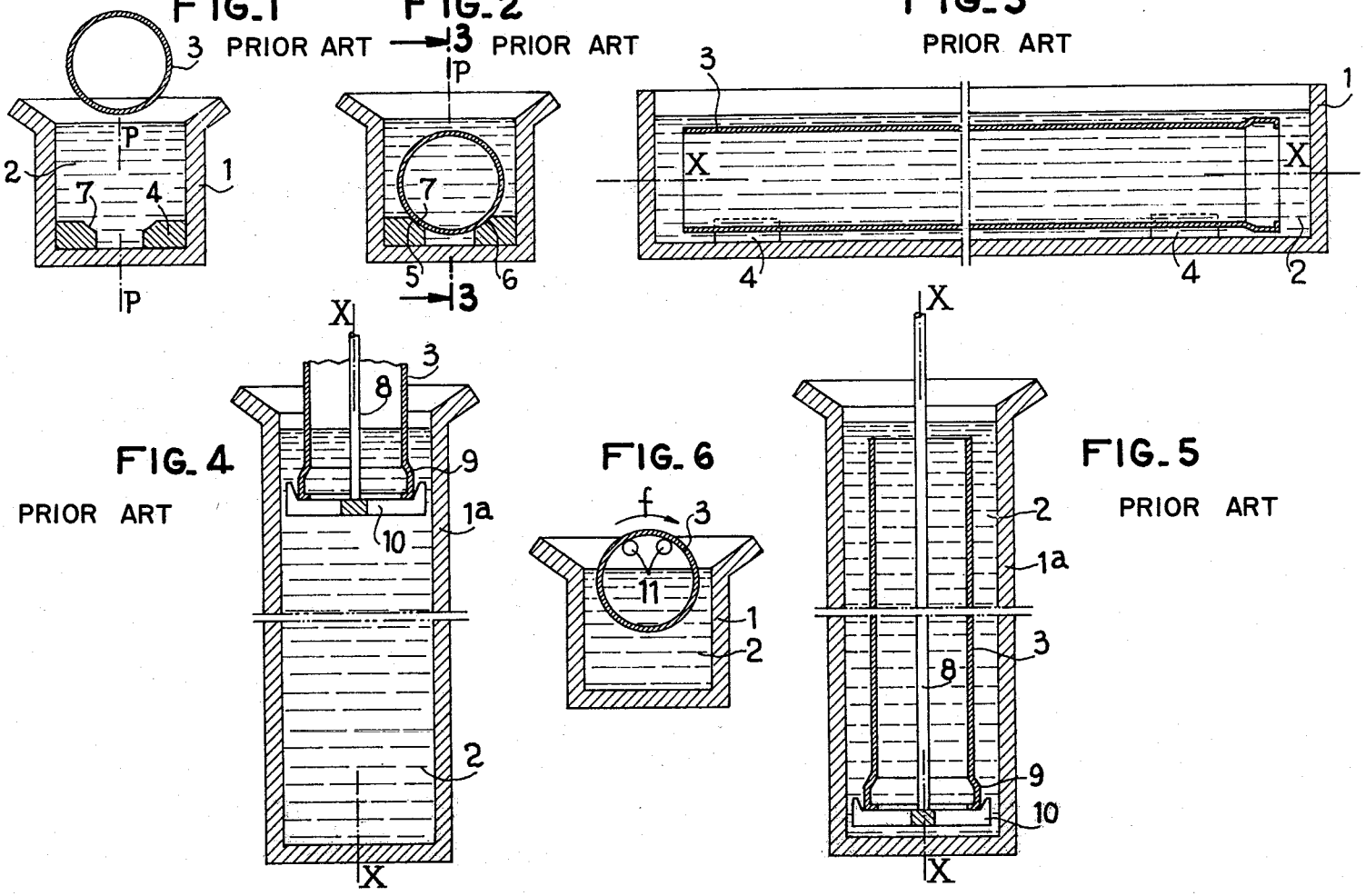
FIG. 1 PRIOR ART
FIG. 2 PRIOR ART
FIG. 3 PRIOR ART
FIG. 4 PRIOR ART
FIG. 5 PRIOR ART
FIGS. 1 and 2 are diagrammatic cross-sectional views of a static heat treating vessel for a cast iron pipe respectively before and after the immersion of the treated pipe in a horizontal position.
FIG. 3 is a sectional view taken on line 3—3 of FIG. 2.
FIGS. 4 and 5 are diagrammatic longitudinal sectional views of another static treatment of a cast iron pipe respectively before and after the immersion of the treated pipe in a vertical position.
FIG. 6 is a cross-sectional view similar to FIG. 2 of a treatment of a cast iron pipe according to the invention with a rotation of the pipe in a horizontal position in the bath.

In the treatment illustrated in FIGS. 1 to 3, there is used a vessel 1 having refractory walls and performing the function of a furnace containing a bath of molten metal 2. This vessel has an elongated horizontal shape of such dimensions as to be capable of receiving a spheroidal graphite cast iron pipe which has just left a centrifugal casting mould or shell (which had been previously coated internally with a wet-spray) in a horizontal position on a set of support blocks 4 and subjecting this pipe to a ferritization heat treatment. Alternatively, the pipe could be of lamellar graphite cast iron made in the same way. The support blocks 4 are secured to the bottom of the vessel 1 in such manner that the pipe 3 bears thereon by two lower generatrices 5 and 6 which are angularly spaced apart and symmetrical with respect to a vertical plane P containing the axis X—X of the pipe 3. The pipe is then fully immersed. The blocks 4 may have a radiused portion 7 as shown in FIGS. 1 and 2 which matches the radius of curvature of the pipe 3.

The annealing or heat treatment is carried out in the following manner:

A pipe 3 which issues still in the hot state from the centrifugal casting machine, for example at a temperature of the order of 600° C., is brought over the vessel 1 while it is driven in rotation about the axis of the pipe and then, after stoppage of the rotation, immersed in the bath 2 until it rests by the two lower generatrices 5 and 6 on the blocks 4.

Almost immediately, the temperature of the pipe 3 rises to that of the bath. At the end of a few minutes, the pipe is withdrawn from the bath and the molten metal is allowed to drip from the pipe above the vessel 1 before the pipe is discharged.

The choice of the metal of the bath depends on the following considerations:

a. In respect of a given cast iron of the pipe 3, the ferritization treatment temperature is chosen within the range of about 650°-800° C. In order to facilitate the dripping or draining of the molten metal from the pipe, it is desirable that the metal of the bath have a temperature of fusion which differs as far as possible from the treatment temperature.

b. Moreover, the higher the treatment temperature the greater the tendency of the pipe to become oval in the bath. It is then desirable to employ for the bath a metal having a high density which is preferably close to that of the cast iron so as to put the immersed pipe in a condition close to weightlessness.

c. This condition is moderated by the toxic vapours which are liberated by certain high-density metals such as zinc (d=7.14) or tin (d=7.3) which require the provision of a suction hood above the vessel 1.

d. Generally, there is preferred a metal which adheres but little to the cast iron. However, in certain applications, the adherence may perform a positive function: if the bath is of zinc or tin, this metal enters the pores of the pipe and may facilitate the adherence of a subsequent coating formed by the same metal.

e. The metal of the bath must not facilitate the production of stray currents by polarity in order to avoid an electrolytic corrosion. For example, copper or aluminium-copper alloys will be avoided.

By way of example, in respect of spheroidal graphite cast iron pipes, a bath of aluminium at about 750° C. is employed. Indeed, notwithstanding its low density (d=2.7) which only slightly intervenes since the tendency of the pipes to become oval in section is low at this temperature, aluminium is advantageous in that no toxic vapours are given off and it adheres but little to the cast iron. The aluminium which does not drip from the pipe is easily subsequently recovered by scraping. There has also been employed a bath of zinc or tin at a temperature between 750° and 800° C. Pipes of a nominal diameter of 800 mm have been annealed after only 4 minutes of immersion in such baths.

The support blocks 4 are of a material refractory at the temperature of the bath and is not liable to have a chemical affinity with the metal constituting this bath, for example steel, possibly protected by a refractory coating of the silico-aluminous type. These blocks may also be merely silico-aluminous bricks or composed of carborundum (C Si).

This heat treatment has the following advantages:

perfect uniformity of the rise in temperature of the pipe since the pipe is immersed in a bath of metal;

rapid rise in temperature of the pipe to the annealing temperature when it enters the bath owing to the phenomenon of heat conduction between the bath 2 and the cast iron pipe 3;

very short annealing time owing to the rapid rise in temperature of the pipe;

good state of the treated pipe, it being possible to subsequently recover the metal of the bath which has not dripped from the pipe;

heat losses limited to the surface of the bath; these heat losses may moveover be considerably reduced by the use of a floating insulating and refractory cover of vermiculite; the heat losses are then practically limited to the fact that a little of the metal is carried away by the pipe as it emerges from the bath;

simplicity of the treatment;

very slight ovalization of the pipe owing to the density of the bath 2 which supports this pipe to a certain extent and to the arrangement of the support blocks which provide a good support for the two symmetrically spaced apart generatrices 5 and 6.

A second heat treatment of a cast iron pipe comprises employing, instead of the vessel 1, a vessel 1$^a$ having the general shape of a cylindrical vertical pit whose inside diameter is slightly greater than the diameter of the pipes 3 to be treated. In the same way as the vessel 1, the vessel 1$^a$ receives only a single pipe 3 at a time.

The pipe 3, bearing by its lower end edge, which is preferably that of the socket 9 of the pipe, on a metal cross-shaped support member 10 fixed to the end of a cable or suspension bar 8, and is plunged into the bath of metal 2 in a vertical position until full immersion coaxially with the vessel 1$^a$.

As before, the temperature of the bath 2 is of the order of 650° to 800° C. and the duration of the immersion is of only a few minutes.

The interest of this second mode is the substantial reduction in the surface area of the bath 2 and consequently the substantial reduction in the heat losses occurring at this surface. On the other hand, the handling of the pipe for its insertion in and withdrawal from the bath is more delicate.

The process according to the invention (FIG. 6) comprises employing a horizontal vessel 1 having the general shape of a cradle as in the treatment of FIGS. 1-3, but avoiding the complete immersion of the pipe 3 in the bath 2 so as to locate the holding, suspension and handling means 11 for the pipe 3 outside this bath.

In this mode, the pipe 3 is partly immersed in the bath 2. Owing to the less homogeneous conditions of the temperature rise relative to the preceding processes involving complete immersion shown in FIGS. 1 to 5, the pipe 3 is driven in rotation in the direction of arrow f by the means 11 throughout the treatment so that the temperature of the pipe may be rendered rapidly even. Moreover, in practice, the duration of the partial immersion is hardly longer than that of the total immersion of the mode illustrated in FIGS. 1 to 3, namely at the most 5 minutes.

The rotation of the pipe about the pipe axis therefore performs a double function. On one hand, it achieves a rapid uniformity of the temperature of the pipe 3 and, on the other, it provides further protection against ovalization of the pipe.

Another advantage of this rotation is that it ensures continuity in the rotation of the pipe, which may be rotated about the pipe axis without stopping during and after withdrawal of the pipe from the centrifugal casting machine, to the end of the annealing treatment until the pipe is sufficiently cooled.

The installation shown in FIGS. 7 to 12 is adapted to carry out the process according to the invention. This installation comprises a vessel 12 having a horizontal axis Y—Y and holding, suspension and driving means 13 for driving the pipe 3 in rotation.

The vessel 12, which performs the function of a reheating furnace, has the shape of a C-sectioned cradle. It is intended to contain the bath of metal 2 up to the level of its axis Y—Y. Its wall is provided internally with a refractory lining 14 which has a wide upper opening 15. The end walls of the vessel 12 have an upper recess or notch 16 which has a symmetrical widely divergent profile defined by four straight segments. The lowest generatrix 17 of the recess 16 is located above the horizontal axis Y—Y of the cross-section of the vessel.

The vessel 12 is provided with known means for heating the bath of metal 2 to maintain it in a state of fusion. These heating means are electrical and comprise inductors 18 disposed symmetrically and obliquely in pairs on each side of the axis X—X and throughout the length of the vessel (FIGS. 7, 10, 11 and 12). Each inductor 18 has internally a bent passageway 19 which is provided for the flow and reheating of the bath of metal and opens by way of two orifices 20 onto the interior of the vessel. The orifices 20 are evenly spaced apart along two generatrices which are symmetrical with respect to the axis X—X and located below this axis. There is achieved in the known manner a continuous circulation or agitation of the bath in several loops by an electromagnetic effect as diagrammatically shown in FIG. 12. In this embodiment, there are three pairs of inductors 18 and therefore three pairs of circulating or agitating loops. Each inductor 18 is cooled by a fan 21.

Figure 11:
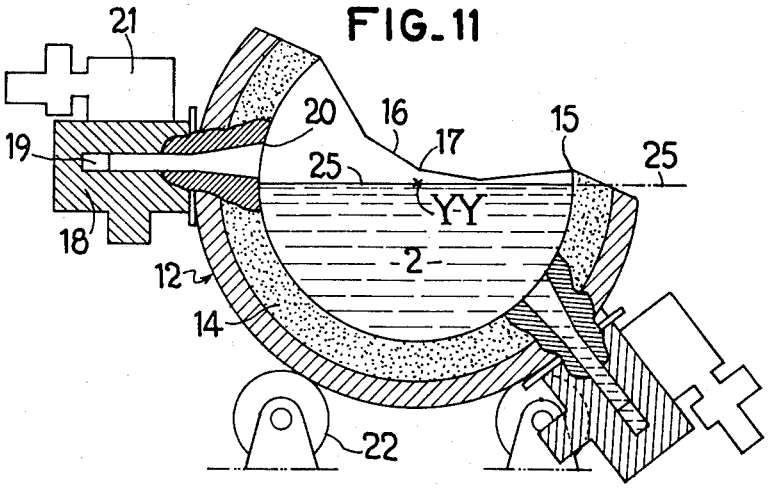
Figure 12:
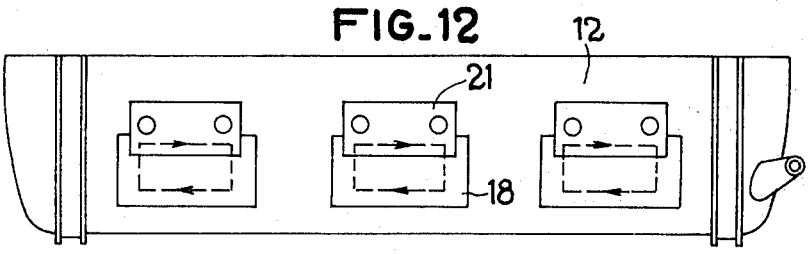
FIG. 12 is an outside view to a reduced scale of the vessel diagrammatically illustrating the means for heating the bath of metal.

The vessel 12 rests on four support rollers 22 having a horizontal axis. One of the rollers 22 is connected to a motor 23 through a speed reducer-inverter unit 24. The vessel 12 can thus be pivoted in either direction about its axis Y—Y to an extent limited by stops (not shown) corresponding to extreme positions in which half of the inductors 18 present their passageways 19 in a horizontal position above the level 25 of the bath for the maintenance or servicing thereof (FIG. 11). The shape of the recess 16 is such that, in this pivoted position of the vessel 12, the recess remains entirely above the level 25. Consequently, the bath 2 cannot overflow. Moreover, the recess 16 permits the passage of means 13 for holding, suspending and driving the pipe 3 in rotation which will be described hereinafter.

Figure 7:
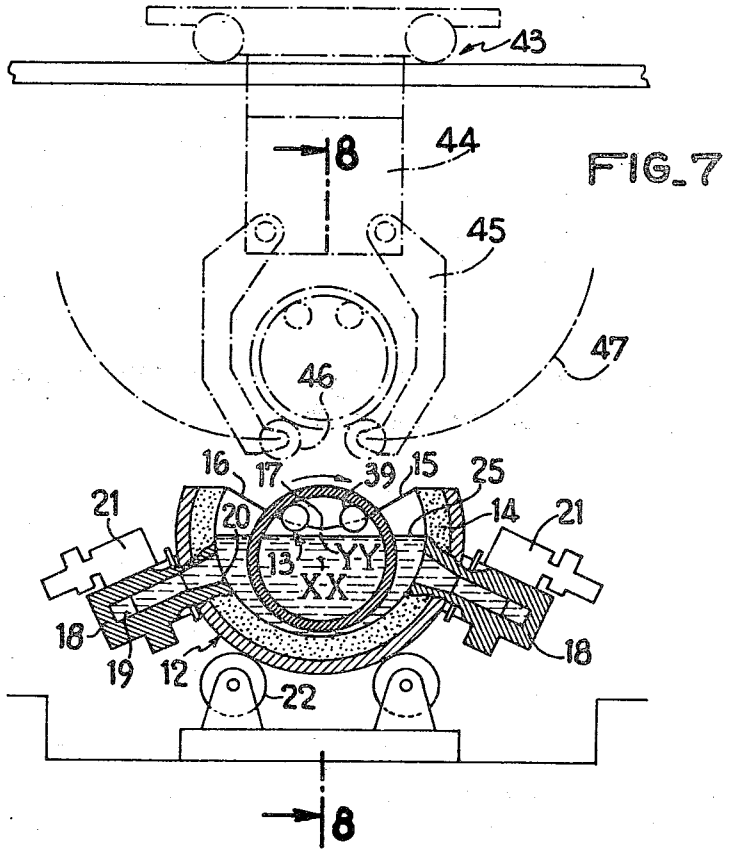
FIG. 7 is a simplified cross-sectional view of an installation for carrying out the invention illustrated in FIG. 6.
Figure 9:
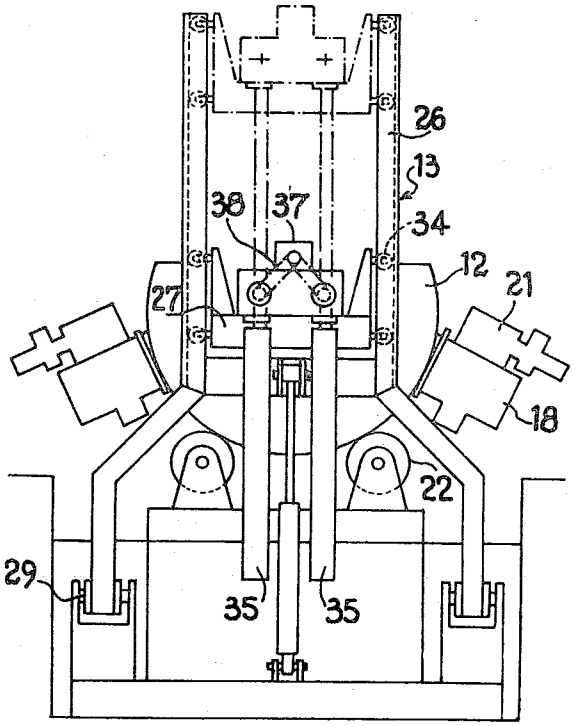
FIG. 9 is an end elevational view of the installation of FIG. 7.
Figure 8:
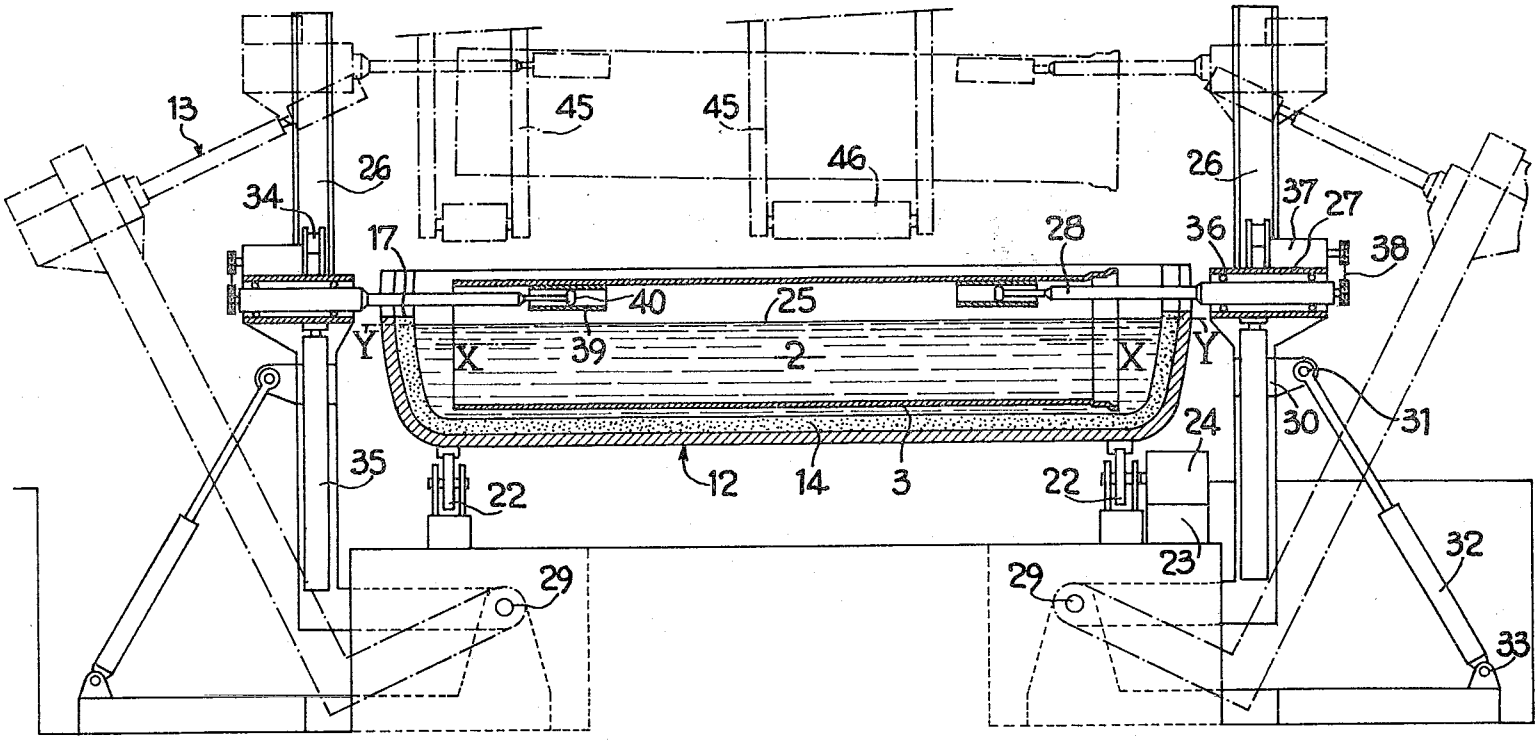
FIG. 8 is a longitudinal sectional view taken on line 8—8 of FIG. 7.

Provided at each end of the vessel 12 is a handling device for each pipe 3 to be immersed (FIGS. 7 to 9). This device comprises two pairs of pivotable guide posts 26 and an elevating carriage 27 guided by these posts 26. Each carriage 27 carries two horizontal arms 28.

The posts 26 are disposed in pairs at both ends of the vessel 12 and thereby form vertical stirrups which leave free a longitudinal access to the rollers 22 supporting the vessel 12. At their lower end the posts 26 of each pair are pivotally mounted on bearings 29. The posts 26 are cranked in their lower part in this embodiment before being pivotally mounted on the bearings 29 so that it is possible to place these bearings under the vessel 12 and consequently limit the overall size of the installation. The overall height of the posts 26 is sufficient to permit raising a pipe 3 substantially above the vessel 12.

Pivotally mounted at 31 on a cross member 30 interconnecting the posts in the region of the middle of the height of each pair of posts is the end of a piston rod of a jack 32 the body of which is pivotally mounted in its lower part at a fixed point 33. Each jack 32 serves to pivot a pair of posts 26 between a vertical position and an inclined position away from the vessel 12 (shown in dot-dash lines in FIG. 8).

Capable of rolling between the two posts 26 of each pair, is the elevating carriage 27 which comprises rollers 34 cooperating with the guiding and rolling U-section of the inwardly facing sides of these posts. Each carriage 27 is shifted for example by a pair of elevating jacks 35 which are secured to the corresponding cross member 30.

Each arm 28 is mounted to be rotatable about an axis perpendicular to the posts 26 owing to the provision of rolling bearings 36 on the carriage 27. Each carriage 27 carries a motor 37 for driving the arms 28 in rotation through endless transmission means 38.

Each arm 28 is capable of crossing the recess 16 of the vessel 18 (when the posts 26 carrying it are vertical) and placing itself in position just above this recess in the lower position of the corresponding carriage 27.

Figure 10:
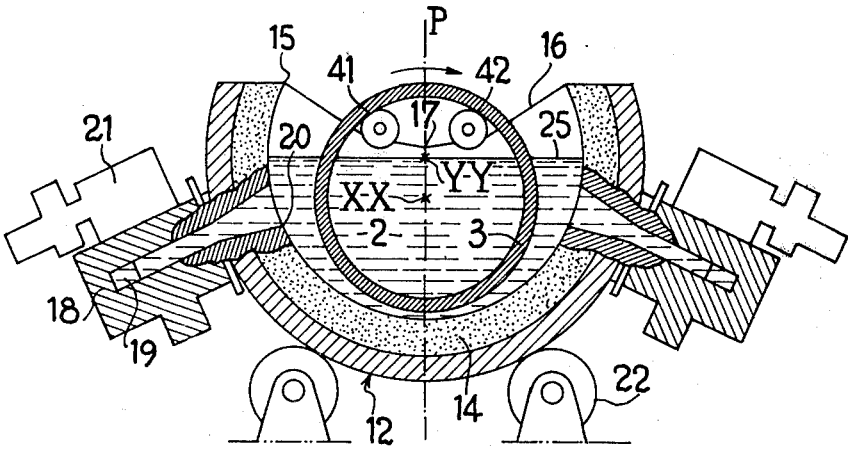
FIGS. 10 and 11 are partial cross-sectional views, to an enlarged scale, of the treating vessel respectively in the operative position and in the pivoted position for the maintenance of the inner wall and in particular of the passageways for agitating the bath of molten metal.

When there are two arms 28 at each end of the vessel as in the present embodiment, these two arms 28 are then disposed symmetrically on each side of the vertical plane P of symmetry of the vessel. By way of a modification, merely a single arm 28 may be provided at each end of the vessel 12, this arm 28 being then disposed in the plane P. Each arm 28 has a length which is sufficient to penetrate inside the C-section of the vessel 12 to a certain distance substantially less than one quarter of the length of the vessel. Owing to the shape of the recess 16, it is ensured that the arms 28 remain in any case above the level 25 of the bath. At its other end each arm 28 is extended by a support roller 39 which is pivotally mounted thereon to have a certain degree of liberty by means of a ball joint 40. Each roller 39 is adapted to support the pipe on an inner contact generatrix. The pipe 3 is consequently supported in this embodiment on two inner contact generatrices 41, 42 which are symmetrical with respect to the vertical plane P (FIG. 10). Owing to the pivotal mounting of the rollers 39, the carriages 37 can be at different heights so as to incline the axis X—X of the suspended pipe 3. Moreover, the ball joints 40 allow a certain freedom of movement to the pipe 3 inside the bath of metal 2 without this requiring a strict alignment between the arms 28 pertaining to opposite ends of the vessel.

The installation shown in FIGS. 7 to 12 operates in the following manner:

It is required to periodically treat pipes 3 which have been centrifugally cast in series, under the conditions of the process described hereinbefore with reference to FIG. 6.

The posts 26 are initially in the position pivoted away from the vessel 12 as shown in dot-dash lines in FIG. 8 so that the arms 28 allow wide access above the vessel for the purpose of bringing a pipe 3 to the vessel. The carriages 27 are in their uppermost position on the arms 26.

A still-hot pipe 3 coming from a centrifugal casting machine (not shown) is conveyed by an overhead crane 43 having a telescopic column 44 carrying two tongs 45 provided with support rollers 46 one of which is provided with a motor (not shown) for driving it in rotation. Consequently, the pipe rotates about its axis without stopping in the course of its transport to above the vessel 12. The jacks 32 are actuated for returning the posts 26 to a vertical position and the arms 28 to a horizontal position. The suspension rollers 39 of the arms 28 are consequently placed inside the pipe and take up their pipe-supporting position. The column 44 of the overhead crane 43 lowers the pipe 3 until it rests on the rollers 39 and leaves the rollers 46 of the tongs 45. This is the position shown in dot-dash lines in FIG. 7. The tongs 45 thereafter spread apart in arcuate paths 47

(shown in dot-dash lines in FIG. 7) and move away from the pipe 3 which is then suspended above the bath 2 by the rollers 39 driven in rotation by the motors 37.

The elevating carriages 27 are simultaneously shifted at the same speed in the downward direction for immersing the pipe 3 in the bath to about ⅔ of its section, the rollers 39 continuing to rotate and drive the pipe 3 in rotation about its axis X—X which is located below the axis Y—Y of the vessel in the plane P (FIGS. 7 and 10). At the lowermost point of their travel, the arms 28 remain above the recess 16 and above the bath 2. In rotating about the axis X—X, the pipe immerses its entire section in the bath 2 whereas its entire section emerges from the bath into the free air before again entering the bath 2.

At the end of the treatment, lasting only a few minutes, the elevating carriages 27 rise along the posts 26 and raise the pipe 3 out of the bath 2. The pipe 3 carries away out of the bath some aluminium which drains away from the pipe and solidifies in the form of sheets which do not adhere to the surface of the pipe 3 and become rapidly detached and fall back into the bath 2. In order to facilitate this draining of the aluminium, it is judicious to raise one of the two carriages 27 slightly higher than the other so as to give the axis of the pipe a certain inclination as shown in dot-dash lines in FIG. 8.

The tongs 45 of the overhead crane 43 move toward each other and close onto and around the pipe 3. The overhead crane 43 rises slightly so as to raise the pipe by the driven rollers 46 and disenagage it from the rollers 39, if desired after re-establishing the horizontality of the pipe. The jacks 32 pivot the posts 26 and thereby withdraw the arms 28 from the pipe. The overhead crane 43 then discharges the treated pipe 3. The overhead crane will later return with another untreated pipe for a new cycle of operations.

Note that as long as the inductors 18 are supplied with current, the metal of the bath 2 is agitated in closed loops between the vessel 12 and the passageways 19 thereby ceaselessly heating the bath and contributing, at the same time as the rotation of the pipe 3, to an acceleration of the heat exchanges between the bath and the pipe which promotes a rapid heat treatment.

For the purpose of maintenance of the bath of metal 2 and in particular the cleaning of the passageways 19, the vessel 8 is pivoted in a direction (FIG. 11) to bring the passageways 19 of one series of inductors 18 in a horizontal position above the level 25 of the bath of metal 2. It will be observed that in this pivoted position, owing to the recess 16 of the vessel, there is free access to the orifices 20 of the passageways 19 while the recess 16 remains above the level 25 of the bath of the metal. In order to clean the passageways 19 located on the opposite side of the vertical plane of symmetry P, the vessel 8 is pivoted in the opposite direction.

Figure 14:
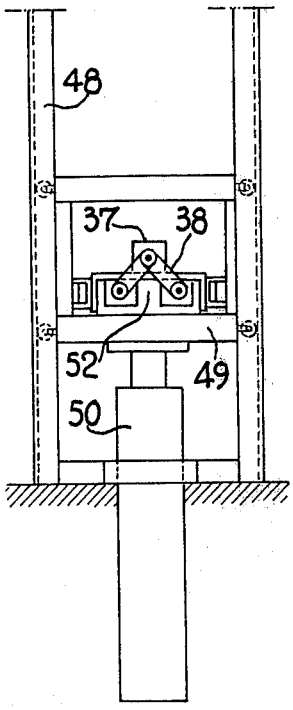
FIG. 14 is a partial end elevational view in the direction of arrows 14 in FIG. 13.
Figure 13:
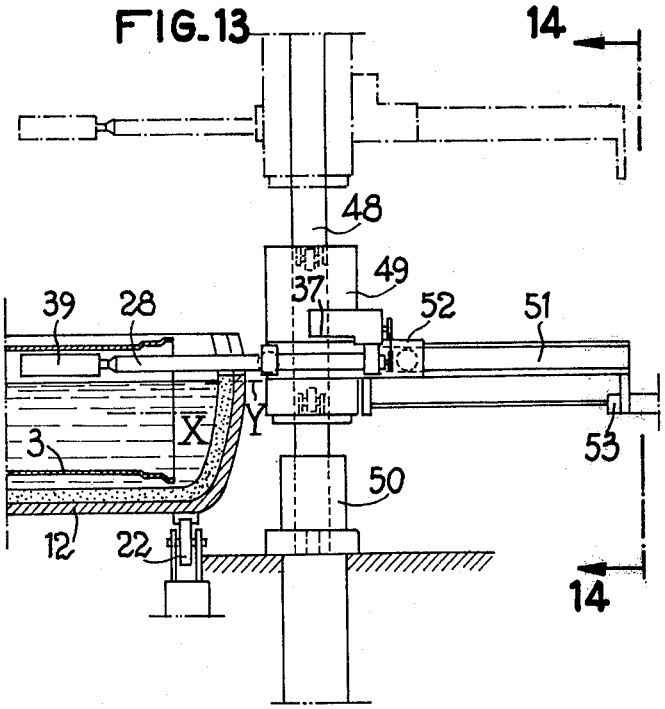
FIG. 13 is a partial longitudinal sectional view of a modification of the installation of FIG. 7.

In another embodiment shown in FIGS. 13 and 14, the pivotable guide posts 26 are replaced by vertical and fixed guide posts 48. There are therefore two pairs of posts 48. Each post has a hollow U-section shape and an elevating carriage 49 is capable of rolling between the posts of each pair. Each carriage 49 is shifted by a jack 50 secured to the posts 48 and carries a pair of horizontal U-section girders 51 for guiding a carriage 52 which rolls therealong in a to-and-fro motion and carries the handling and holding arms 28. Provided on the horizontal carriage 52 are the motor 37 for driving the pipe in rotation through endless transmission means 38 and the arms 28 for rotating the pipe 3 about the pipe axis. The carriage 52 is shifted in the forward and rearward directions, for example by a horizontal jack 53 the body of which is connected to the girder 51 and the rod of which is connected to the carriage 52.

This embodiment of the installation operates in the following manner:

When the overhead crane 43 of FIG. 7 supplies a pipe 3 to be immersed in the vessel 12, the horizontal carriage 52 withdraws to the end of its travel for withdrawing the arms 28 and their rollers 39. The elevating carriages 49 rise to the height corresponding to the insertion of the arms 28 in the pipe 3. The carriage 52 advances to the maximum of its travel so as to insert the arms 28 in the pipe 3 and the carriages 49 rise a little more so as to raise this pipe off the support rollers 46 of the overhead crane.

At this moment, the tongs 45 move apart and the pipe 3 is supported by the rollers 39 of the arms 28. Owing to the action of the motor 37 and the rotation of the arms 28, the pipe 3 continues to rotate about the pipe axis. The carriages 49 descend along the posts 48 to partly immerse the pipe 3 in the bath of metal 2. A few minutes later, these carriages 49 rise and return the pipe 3 between the tongs 45 of the overhead crane and these tongs close under the pipe. The carriages 49 descend a little so as to place the pipe on the rollers 46 of the tongs 45. The carriage 52 moves back to the maximum of its travel to withdraw the arms 28 and the rollers 39 from inside the pipe. The treated pipe 3 is discharged by the overhead crane 43 which will later return with another pipe for a new cycle of operations.

Figure 15:
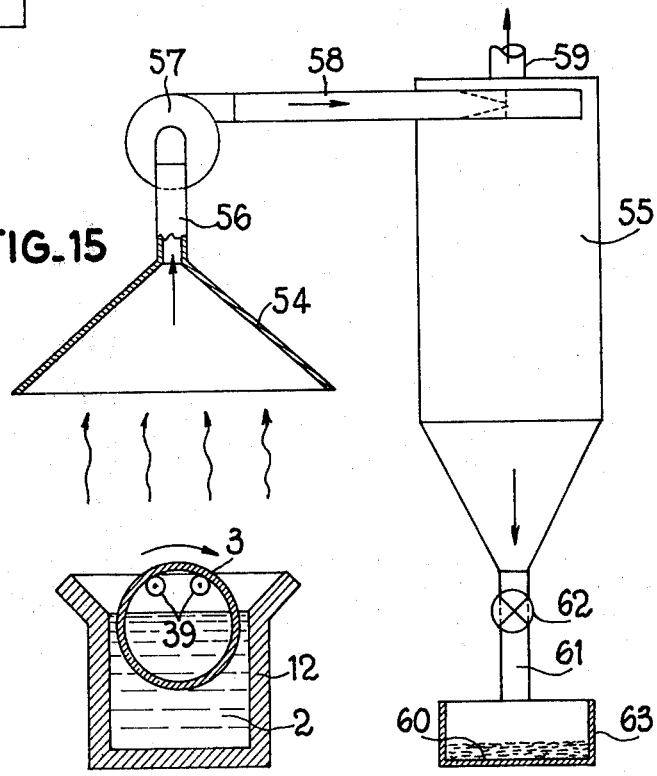
FIG. 15 is a diagrammatic cross-sectional view of a modification of the installation according to the invention provided with a hood above the bath of metal.

FIG. 15 shows diagrammatically how the installation may be modified in the case where the bath 2 consists of a metal such as zinc or tin which liberates toxic vapours. Disposed above the vessel 12 is a suction hood 54 which is connected to a cyclone 55 having a vertical axis by a duct 56, a fan 57 and a tangential duct 58. The fumes drawn off from the solid particles of metal are discharged by a duct 59 of the cyclone and these particles 60 may be recovered in a container 63 at the outlet of a lower pipe 61 of the cyclone which is controlled by a valve 62.

Having now described my invention what I claim as new and desire to secure by Letters Patent is:

1. A process for effecting a heat treatment of a metal pipe, comprising engaging end portions of the pipe by rotary driving means in a region of the pipe above the axis of the pipe, driving the pipe in rotation about the axis of the pipe by said rotary driving means while suspending the pipe in a substantially horizontal position and partly immersing the pipe in a bath of molten metal at the desired temperature so that said region of the pipe and said rotary driving means are located above the level of the molten metal.

2. A process as claimed in claim 1 for effecting a ferritization heat treatment above 750° C. on a spheroidal graphite or lamellar graphite cast iron pipe, wherein a metal selected from the group consisting of zinc and tin is employed for the bath and the vapours formed above the bath are discharged.

3. An installation for effecting an annealing heat treatment of a spheroidal or lamellar graphite cast iron pipe, comprising a vessel having an elongated shape and a horizontal axis, a bath of molten metal contained in the vessel, and withdrawable means outside the bath for suspending the pipe in a substantially horizontal position and for plunging the pipe partly in the bath and simultaneously driving the pipe in rotation about the axis of the pipe, the pipe suspension and driving means comprising rotary arms which are substantially horizontal and parallel to the axis of the vessel in an operative position of the arms in which operative position the arms are located above the surface of the bath of metal contained in the vessel.

4. An installation as claimed in claim 3, comprising means defining end parts of the arms which end parts are freely pivotable to a limited extent relative to the axis of the vessel.

5. An installation as claimed in claim 3, comprising posts at each end of the vessel and carriages movable along the posts and carrying the arms.

6. An installation as claimed in claim 5, wherein each post is mounted to be pivotable about an axis perpendicular to the axis of the vessel.

7. An installation as claimed in claim 6, wherein the pivot axes of the posts are located below the vessel.

8. An installation as claimed in claim 5, wherein the posts are fixed in position and the rotary arms are axially movable relative to the posts to enable the arms to be withdrawn from the pipe.

9. An installation for effecting a heat treatment of a metal pipe, comprising a vessel having an elongated shape and a horizontal axis and for receiving a bath of molten metal up to a given level in the vessel, and rotary means for engaging end portions of the pipe in a region of the pipe above the pipe axis for carrying and driving the pipe in rotation about the pipe axis and movable between a withdrawn first position in which position the pipe is remote from the vessel and molten metal and a second position in which second position the pipe carrying and driving means are located adjacent the vessel above said level and the pipe is partly immersed in the molten metal and said region of the pipe is located above said level with the pipe axis substantially horizontal.

10. An installation as claimed in claim 9 comprising devices for heating and agitating the bath of metal associated with the vessel.

11. An installation as claimed in claim 9, wherein the vessel has an open top and is mounted to be pivotable about the axis of the vessel for maintenance purposes.

12. An installation as claimed in claim 11, wherein the vessel has end walls, each end wall having an upper edge which defines a substantially V-shaped recess and said edge is completely above the level of the bath of metal in all positions of the vessel.

13. An installation as claimed in claim 9, comprising a suction hood disposed above the vessel and connected to a cyclone for drawing off vapours from the bath of metal.

14. An installation for effecting an annealing heat treatment of a spheroidal or lamellar graphite cast iron pipe, comprising a vessel having an elongated shape and a horizontal axis, a bath of molten metal contained in the vessel, and withdrawable means outside the bath for suspending the pipe in a substantially horizontal position and for plunging the pipe partly in the bath and simultaneously driving the pipe in rotation about the axis of the pipe, the installation further comprising an overhead crane and openable tongs carried by the crane and capable of engaging and bringing the pipe above the vessel, the tongs including pipe-supporting rollers, at least one of which rollers is provided with a driving motor.

15. An installation as claimed in claim 14, comprising a telescopic column interposed between and interconnecting the crane and the tongs.

16. An installation for effecting a heat treatment of a metal pipe, comprising a vessel having an elongated shape and a horizontal axis and for receiving a bath of molten metal up to a given level in the vessel, and rotary means for carrying and driving the pipe in rotation about the axis of the pipe, said means comprising rotary means for engaging end portions of the pipe on the inside of the pipe in a region of the pipe above the pipe axis, said rotary means being movable between a withdrawn first position in which position the rotary means and pipe are remote from the vessel and molten metal and a second position in which second position said rotary means are located adjacent the vessel and above said level and the pipe is partly immersed in the molten metal and said region of the pipe is located above said level and the axis of the pipe is substantially horizontal.

* * * * *